United States Patent [19]

Miyamoto et al.

[11] Patent Number: 5,006,829

[45] Date of Patent: Apr. 9, 1991

[54] INFORMATION DISPLAY SYSTEM FOR A VEHICLE

[75] Inventors: Osamu Miyamoto; Hideki Kanou; Kazuo Nakamura; Takeshi Imai; Kenichi Nishida, all of Saitama, Japan

[73] Assignee: Honda Giken Kogyo K.K., Tokyo, Japan

[21] Appl. No.: 176,496

[22] Filed: Mar. 31, 1988

[30] Foreign Application Priority Data

| | | | |
|---|---|---|---|
| Mar. 31, 1987 | [JP] | Japan | 62-79282 |
| Mar. 31, 1987 | [JP] | Japan | 62-79285 |
| Mar. 31, 1987 | [JP] | Japan | 62-79290 |

[51] Int. Cl.[5] ..... G08B 19/00

[52] U.S. Cl. ..... 340/459; 340/457.4; 340/462

[58] Field of Search ..... 340/52 F, 52 D, 521, 340/459, 461, 462, 457, 457.4; 364/424.03

[56] References Cited

U.S. PATENT DOCUMENTS

| | | | |
|---|---|---|---|
| 4,287,503 | 9/1981 | Sumida | 340/52 F |
| 4,344,136 | 8/1982 | Panik | 340/52 F X |
| 4,356,470 | 10/1982 | Kogawa et al. | 340/52 F |
| 4,497,057 | 1/1985 | Kato et al. | 340/52 F X |
| 4,503,419 | 3/1985 | Kidd et al. | 340/52 F X |
| 4,555,694 | 11/1985 | Yanagishima et al. | 340/52 F X |
| 4,663,718 | 5/1987 | Augello et al. | 340/52 F X |
| 4,787,039 | 11/1988 | Murata | 340/52 F X |

FOREIGN PATENT DOCUMENTS

| | | |
|---|---|---|
| 51-20787 | 6/1976 | Japan . |
| 53-87694 | 8/1978 | Japan . |
| 56-112336 | 9/1981 | Japan . |

*Primary Examiner*—Joseph A. Orsino
*Assistant Examiner*—Brian R. Tumm
*Attorney, Agent, or Firm*—Skjerven, Morrill, MacPherson, Franklin & Friel

[57] ABSTRACT

An information display system for a vehicle includes: a plurality of sensors for detecting various conditions of the vehicle; a display unit for displaying a selected one of a plurality of items of information relating to the conditions of the vehicle as detected by the corresponding sensors; a pair of manual for sequentially shifting the item of information which is currently displayed on the display unit; and a control unit for producing one of the items of information on the display unit according to output from one of the sensors. The control unit is further adapted to change the item of information which is currently displayed to a display of a default item of information, when the current display was manually selected, upon elapsing of a certain time interval after the manual selection of the current item of information for display. The control unit is capable of selecting at least two items of information for display, and the display unit assigns an indicator to each of the selected and displayed items to indicate that an additional item for dispaly exists. Thus, sufficient information which the driver of the vehicle may wish to know can be displayed in a limited space of the display unit.

27 Claims, 10 Drawing Sheets

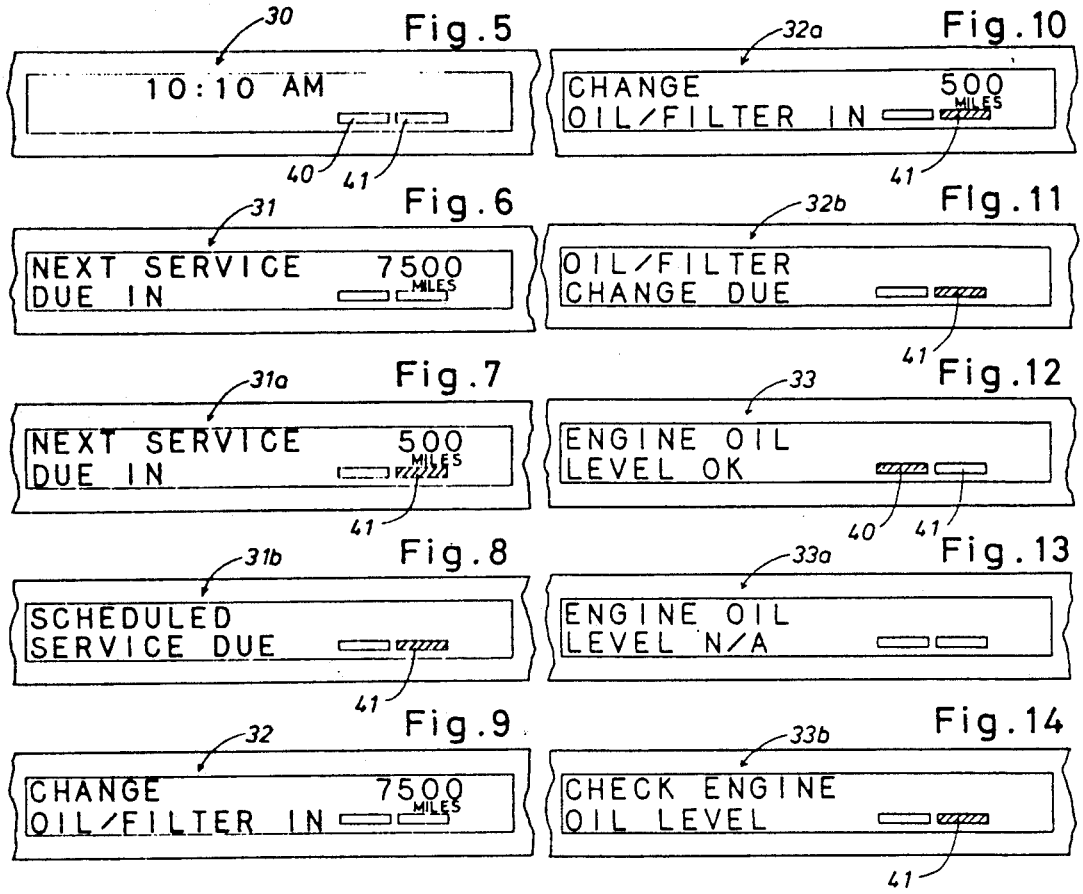
Fig.5 Fig.6 Fig.7 Fig.8 Fig.9 Fig.10 Fig.11 Fig.12 Fig.13 Fig.14
Fig.15
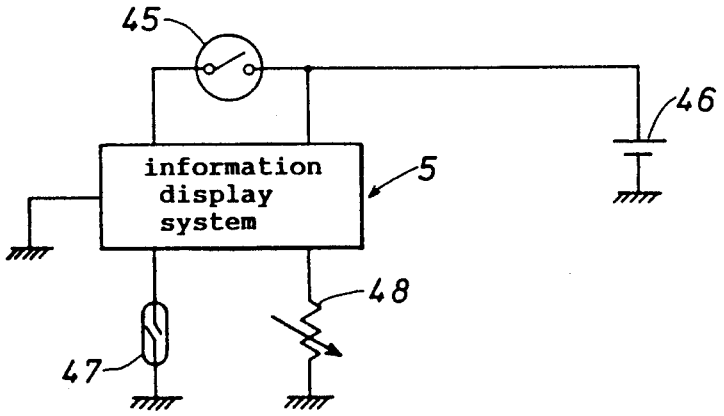

INFORMATION DISPLAY SYSTEM FOR A VEHICLE

TECHNICAL FIELD

The present invention relates to an information display system for selectively indicating various states and conditions of a vehicle related to the normal operation of the vehicle and the execution of maintenance work and servicing which are required from time to time for maintaining the proper functioning of the vehicle.

BACKGROUND OF THE INVENTION

Various forms of information display systems have been proposed in the past for the purpose of indicating the operating conditions and the internal states of the vehicle. For instance, Japanese patent publication No. 51-20787 proposed a system in the form of a centralized warning system. According to this proposal, a number of check points are selected in advance and any abnormal states found at these check points are displayed as warning signals according to a certain hierarchy of priority scaled to the degree of importance. The display unit for this display system is so small that it can therefore show only a limited amount of information at any given moment. As a matter of fact, this is generally the case with display systems of this kind. Therefore, if more than one abnormal condition has occurred, the system is capable of indicating only one of the abnormal conditions and all the necessary measures may not be taken at a sufficiently early stage.

To the end of eliminating this problem, Japanese patent laid open publication No. 53-87694 discloses an information display system which is provided with means for indicating that there are a plurality of items to be displayed by giving a display literally saying "plural". However, this system can not display the content of any one of the plural additional abnormal conditions and cannot indicate how many items are detected to be in abnormal conditions and are required to be displayed.

Beside from this problem, as the number of items of information to be displayed increases, the handling of the information display system becomes less favorable and the convenience of the system tends to be diminished. It is therefore desired to have an information display system which occupies little space by having a small display area and a limited number of switches and yet can display a comprehensive range of information without requiring any complicated handling on the part of the user.

The quantity of fuel remaining in the tank and the distance which can be covered with the fuel remaining in the tank are important items of information which are desired to be displayed as trip function information. Japanese patent laid open publication No. 57-12322 discloses such a method of computing the distance that can be covered with the fuel remaining in the tank. According to this method, the distance is displayed only when the quantity of the fuel remaining in the tank has agreed with one of a plurality of key values. Japanese patent laid open publication No. 56-112336 proposes a method and apparatus for issuing a warning with synthesized speech when the quantity of the fuel remaining in the tank has reached one of two values and using different warnings for the two different values.

These proposals have the disadvantage that the display is intermittent and does not provide a continual display of the trip information. Furthermore, the computation of the distance that can be covered by the fuel remaining in the tank tends to be inaccurate because the detection of the quantity of the fuel in the fuel tank involves a greater error as the quantity decreases. This is particularly significant when the fuel quantity is estimated from the cumulative flow rate of fuel injection in the engine because the error accumulates as the fuel level drops.

Most items of the trip information are based on the cumulative mileage of the vehicle. Therefore, if the cumulative mileage stored in the memory of the control unit is erased due to power outage, repair or other servicing, accurate management of the vehicle is not possible any more. Therefore, it is desired to have means for reinstalling the cumulative mileage when it is erased from the memory without sacrificing the simplicity of the handling of the information display system.

Trip information related to the gas mileage of the vehicle requires an indication of the filling the fuel tank. A float level meter is typically equipped to the tank but is unsuitable for accurately detecting the full level of the fuel tank because it tends to indicate the full level of the fuel tank whenever the fuel level is close to the actual full level. Japanese patent publication No. 58-38726 proposes a device for displaying the distance that can be covered by the vehicle and the quantity of the fuel remaining in the tank. According to this proposal, the driver turns on a certain manual switch when the fuel tank is filled up. The distance that can be covered by the vehicle with the remaining fuel is computed according to a certain average fuel mileage when the quantity of the fuel remaining in the tank is large and this fuel mileage is updated with current fuel mileage as the quantity of the fuel in the tank gets less.

However, if one forgets to turn on the tank full switch, the information display system cannot display any information related to fuel consumption until the vehicle makes a next stop to fill up the fuel tank. It may be possible to assume that the tank has been filled up if the ignition switch is turned on when the float sensor indicates a substantially full fuel level in the tank. However, since a tank full state is assumed every time the ignition switch is turned on with a substantially full tank, the accuracy of the display based on this information may not be sufficiently accurate.

BRIEF SUMMARY OF THE INVENTION

In view of such problems of the prior art, a primary object of the present invention is to provide an improved vehicle information display system which permits recognition of all the items of information to be displayed with a limited capacity of a display unit even when there is a large number of items of information to be displayed.

A second object of the present invention is to provide a vehicle information display system which allows the evaluation of various conditions of a vehicle and is yet easy to use.

A third object of the present invention is to provide a vehicle information display system which permits the monitoring of the distance that can be covered by the quantity of fuel remaining in the tank or of the quantity itself in such a manner that the user can obtain relevant and accurate information readily at all times.

According to the present invention, these and other objects of the present invention can be accomplished by providing an information display system for a vehicle, comprising: a plurality of sensors for detecting various conditions of the vehicle; a display unit for displaying a selected one of a plurality of items of information relating to the conditions of the vehicle as detected by the corresponding sensors; manual switch means for sequentially shifting the item of information which is currently displayed on the display unit; and a control unit comprising automatic selection means for producing one of the items of information on the display unit according to output from one of the sensors; the control unit further comprising automatic shifting means for changing the item of information which is currently displayed to a display of a default item of information, when the current display was manually selected, upon elapsing of a certain time interval after the manual selection of the current item of information for display.

Thus, the user is not required to restore the display to the one which is desired to be displayed most of the time. Further, if the display is produced automatically by an interruption routine of the control unit, it is convenient for the user if the display is retained until the user intentionally resets the system or removes the abnormality which caused the current display.

According to a certain aspect of the present invention, the automatic selection means is capable of selecting at least two items of information for display, and the display unit is provided with means for indicating that at least one more additional item was automatically selected by the automatic selection means of the control unit as a candidate to be displayed. Preferably, the items of information include an abnormal state of the vehicle and a transition of an abnormal state of the vehicle to a normal state of the vehicle.

Thus, by indicating the existence of at least one more additional item of information on an abnormal condition of the vehicle simultaneously as the item of information which is currently being displayed, one can obtain comprehensive information on the state of the vehicle in the limited space of the display area of the display unit.

According to a further aspect of the present invention, the control unit includes priority assigning means for assigning a priority of display to an item of information on an abnormal condition or a transition from an abnormal condition to a normal condition over other items of information for display as the current item of information is shifted by the manual switch means. Preferably, the priority may be given to a plurality of items of information at a time, and a relatively higher priority is given to the item of information on an abnormal condition or a transition from an abnormal condition to a normal condition of a relatively new occurrence.

Thus, the user can know a plurality of items of information in the order of their importance in the limited space of the display area of the display unit without requiring any complicated operation.

According to a yet further aspect of the present invention, the manual switch means comprises: a trip function switch for shifting the current item of information displayed on the display unit from one item of information related to a trip function to another item of information related to another trip function in an endless manner; a maintenance information switch for shifting the current item of information displayed on the display unit from one item of information related to a maintenance item of the vehicle to another item of information related to another maintenance item of the vehicle in an endless manner; and means for switching the item of information for display from an item of information related to one of the trip functions to an item of information related to one of the maintenance items in case the maintenance information switch was activated when the item of information related to one of the trip functions was being displayed on the display unit, and vice versa.

Thus, a large number of items of information can be selected with a minimum number of switches with a high degree of accessibility to each of the items.

According to a yet further aspect of the present invention, the sensors include: means for detecting a quantity of fuel in the tank of a vehicle; means for detecting the mileage covered by the vehicle; means for computing a distance which the vehicle can cover with the quantity of fuel remaining in the tank; means for displaying the distance which the vehicle can cover with the quantity of fuel remaining in the tank on the display unit when the quantity of fuel remaining in the tank is greater than a first value and displaying the quantity of fuel remaining in the tank on the display unit when the quantity of fuel remaining in the tank is not greater than the first value.

Thus, accuracy and convenience are both obtained in monitoring the remaining quantity of the fuel in the tank and the distance which the vehicle can cover with this fuel.

BRIEF DESCRIPTION OF THE DRAWINGS

Now the present invention is described in the following in terms of concrete embodiments with reference to the appended drawings, in which:

FIGS. 5 through 14 are front views of the display area of the preferred embodiment showing different displays thereon;

FIG. 15 is a circuit diagram showing a structure for detecting an engine oil level according to the present invention;

DETAILED DESCRIPTION OF THE PREFERRED EMBODIMENTS

Figure 1:
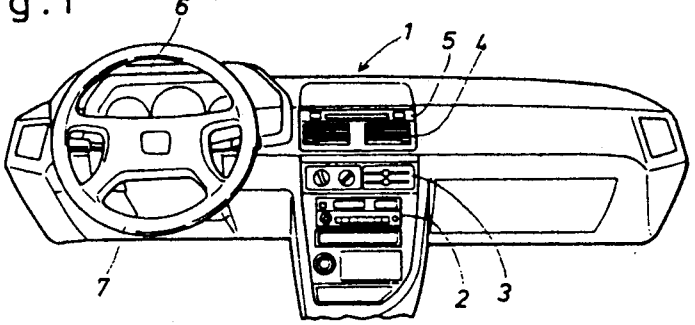
FIG. 1 is a front view of a dashboard of a vehicle which is equipped with a preferred embodiment of the information display system according to the present invention.

FIG. 1 shows a dashboard 1 of an automobile to which a preferred embodiment of the present invention has been applied. A center console 2 accommodating audio equipment is provided in a central lower part of the dashboard 1, and an air conditioning system 3 and a pair of air outlets 4 are arranged above the center console 3 one over the other. An information display system 5 according to the present invention is fitted above the air outlets 4. In the present embodiment, since the driver's seat is located in the left side of the vehicle, an instrument panel 6 and a steering wheel 7 are provided to the left of the information display system 5 and the center console 2.

Figure 2:
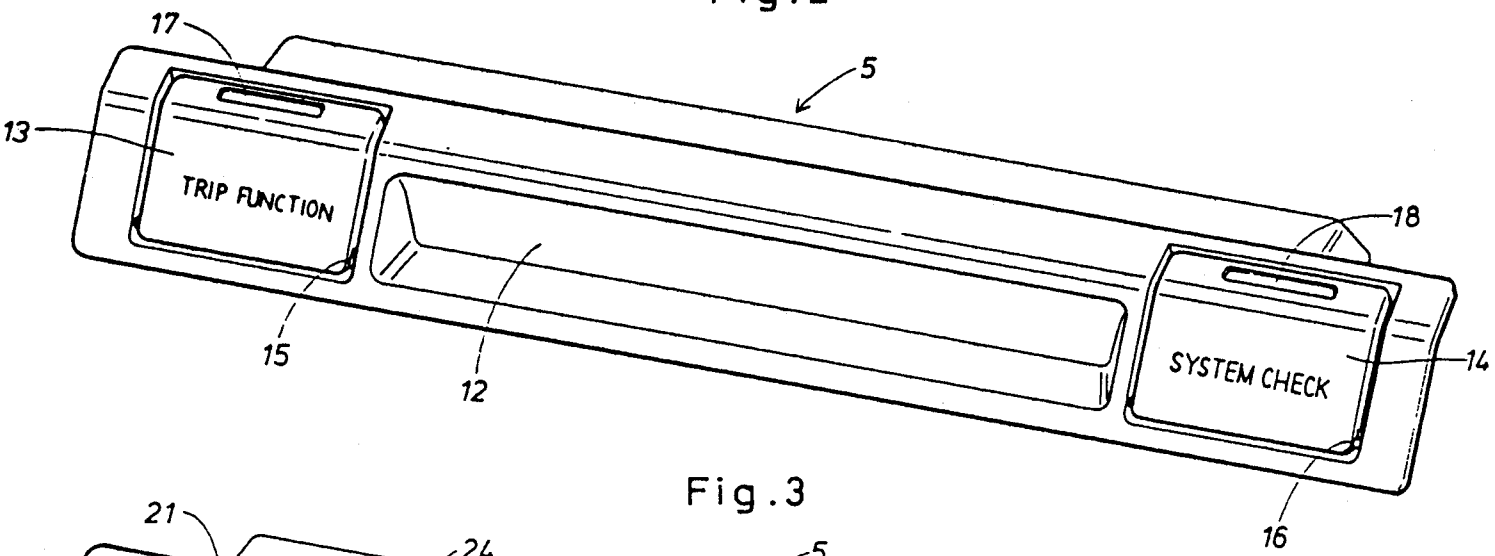
FIG. 2 is a perspective view of the information display system shown in FIG. 1.
Figure 3:
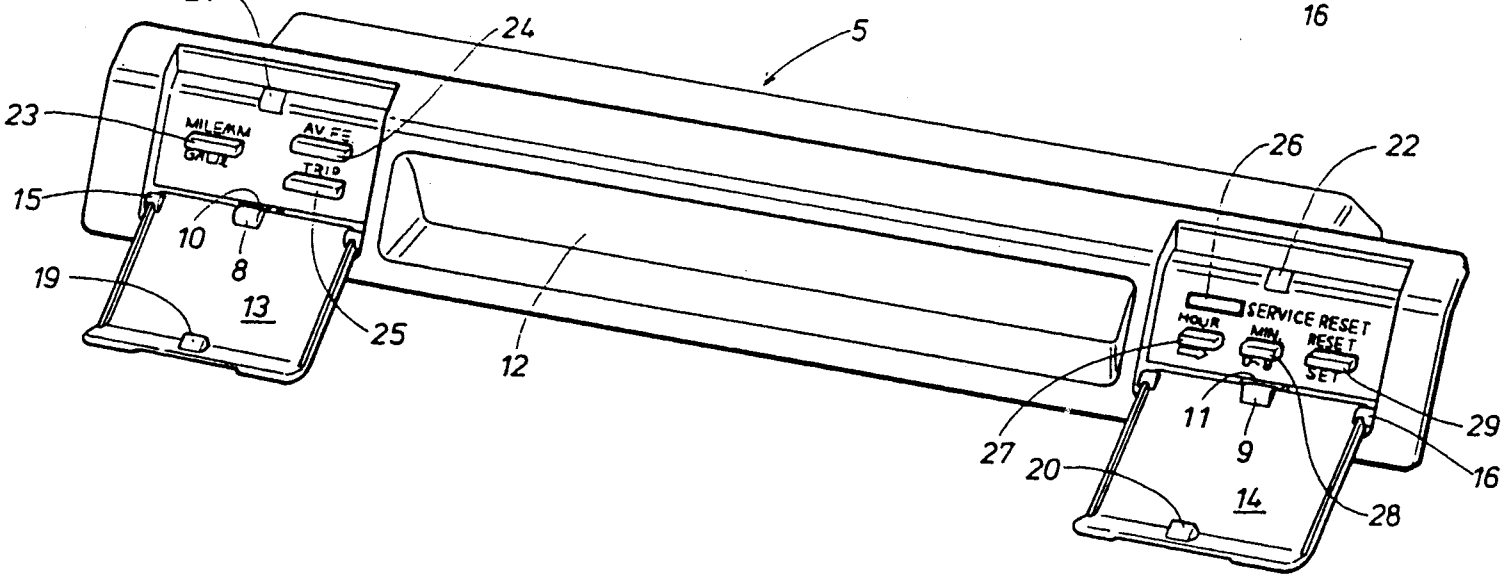
FIG. 3 is a view similar to FIG. 2 with the lids opened up to reveal the arrangement of the push-button switches for setting initial conditions.

FIGS. 2 and 3 show the details of the information display system 5. This information display system 5 is provided with a box-shaped casing having a wide and low profile. A central front face of the casing is provided with a display area 12 consisting of a fluorescent display device, and a pair of relatively large and square push-buttons 13 and 14 are arranged on either side of the display area 12. These push-buttons 13 and 14 are attached to the casing by way of hinges 15 and 16 at their lower parts, and are provided with depressions 17 and 18 at their upper parts so that they may be closed and opened about the corresponding hinges 15 and 16 in the manner of lids as desired by engaging a finger with the depressions 17 and 18. These push-buttons 13 and 14 are kept in their closed states by elastically engaging with the casing. The projections 8 and 9 provided in the reverse surfaces of the lower parts of the push-buttons 13 and 14 are made of rubber-like material and urge the corresponding push-buttons 13 and 14 towards their open positions so as to give a push to the push-buttons in an early stage of their opening action and improve the handling of the push-buttons 13 and 14 as lids.

A projection 19 or 20 is provided in the reverse surface of an upper part of each of the push-buttons 13 and 14 while a corresponding elastically supported member 21 or 22 connected to a switch element (not shown in the drawings) is provided in the casing in such manner that an electric switching action is performed as one of the push-buttons 13 and 14 is pressed from its exterior surface, by way of the corresponding elastically supported member 21 or 22. Further, as shown in FIG. 3, the parts of the casing which are covered by the push-buttons 13 and 14 in their closed states are provided with three and four small switch keys 23 through 29, respectively.

References to those elements of FIGS. 1–3 designated by reference numerals 5–29 in the following refer to FIGS. 1–3.

Figure 4:
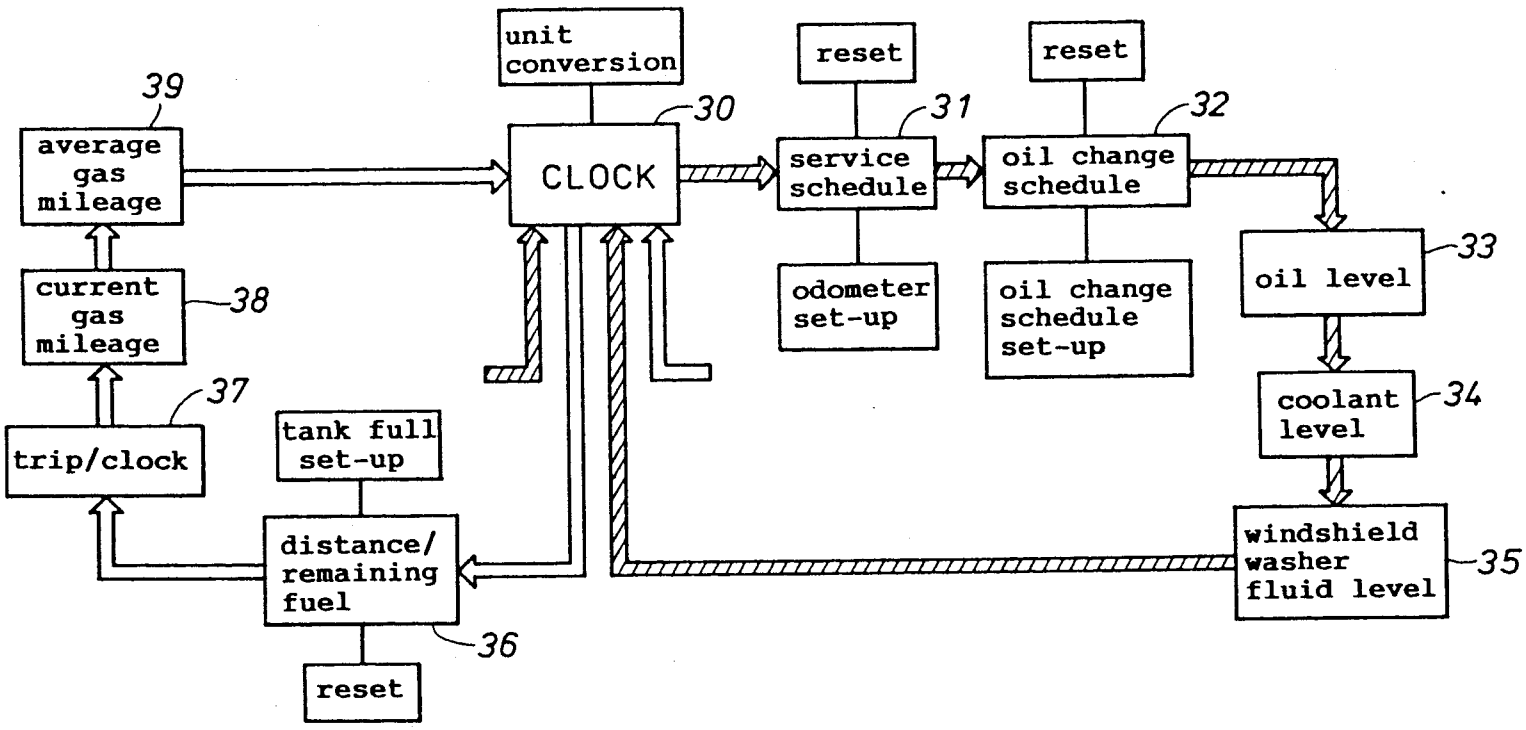
FIG. 4 is a chart for illustrating the action of the preferred embodiment of the information display system according to the present invention.

FIG. 4 shows the overall action of the present embodiment, and, in this drawing, the non-hatched arrows denote the action of pressing the push-button 13 for selecting an item of trip function information while the hatched arrows denote the action of pressing the push-button 14 for selecting an item of system check or maintenance information.

Figure 25:
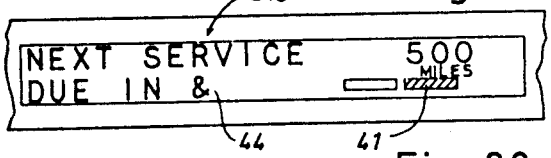

The display area 12 normally displays the current time 30 display as shown in FIG. 5. Every time the system check push-button 14 is pressed, the contents of the display change into a next servicing schedule display 31 (FIG. 6), an engine oil replacement mileage display 32 (FIG. 9), an engine oil level display 33 (FIG. 12), a coolant level display 34 (FIG. 20) and a washer fluid level display 35 (FIG. 25), in a sequential manner. If the system check push-button 14 is pressed while the washer fluid level display 35 is on the display area 12, the current time display 30 is obtained on the display area 12. Also, when any of the displays 31 through 35 are selected and kept for more than a certain time period, for instance 10 seconds, a default display, in this case the current time display 30, automatically comes back on the display area 12.

Likewise, when any one of the above mentioned system check displays 31 through 35 is on the display area 12, pressing the trip function push-button 13 makes the current time display 30 appear on the display area 12. And, every time the trip function push-button 13 is subsequently pressed, the display on the display area 12 changes to a cruising range (with the fuel remaining in the tank)/remaining fuel display 36 (FIG. 28), a trip/-time display 37 (FIG. 31), a current fuel mileage display 38 (FIG. 32) and an average fuel mileage display 39 (FIG. 33). If the system check push-button 14 is pressed when any one of the above mentioned trip function displays 36 through 39 is on the display area 12, the current time display 30 comes back on the display area 12.

In the present embodiment, the trip information push-button 13 is provided to the left hand side of the display area 12 or on the side of the driver seat while the maintenance information push-button 14 is provided to the right hand side of the display area or further away from the driver seat than the display area 12 because the trip information push-button 13 is much more frequently and casually used by the driver than the maintenance information push-button 14. Furthermore, the maintenance information push-button 14 is desired to be pressed by mistake much less than the trip information push-button 13 is due to their functions. Obviously, if the driver's seat is located to the right hand side of the vehicle, as is the case in Japan and the United Kingdom, the trip information push-button 13 should be located to the right hand side of the display area 12 while the maintenance information push-button 14 should be located to the left hand side of the display area 12, to obtain the same effect.

Now, the display contents relating to the maintenance or system check information are described in the following with reference to FIGS. 5 through 14.

FIG. 5 shows the current time display 30 which by itself is not different from a conventional digital clock time display.

FIG. 6 shows the next servicing schedule display 31 in normal condition. If the regular maintenance servicing is scheduled for every 7,500 miles, by pressing the service reset key 26 hidden behind the the maintenance information push-button 14 produces a display of "7,500 miles" in the upper right corner of the display area 12. This distance is decremented by the mileage covered by the vehicle. If the total mileage of the vehicle is 500 miles short of the next scheduled servicing, it is indicated by lighting a yellow LED lamp 41 provided in a right hand part of the display area 12 as well as a display 31*a* to this effect given in the main display area 12, as shown in FIG. 7. If the vehicle has covered more than 7,500 miles after the preceding servicing or after the service reset key 26 was pressed last time, it is displayed as shown in FIG. 8 and a warning lamp which may be placed in the instrument panel 6 is additionally lighted up. The displays 31*a* and 31*b* are automatically produced when the corresponding mileages have been detected as interruption routines and they are accompanied by activation of a warning buzzer (not shown in the drawings). The service reset key 26 does not project from the casing surface as opposed to the other keys 27 through 29 for the purpose of reducing the possibility of the service reset key 26 being inadvertently pressed by mistake.

FIG. 9 shows the engine oil replacement schedule display 32 and, in this case also, it is scheduled for every 7,500 miles. When the mileage of the vehicle is short of the scheduled next engine oil replacement stop by 500 miles, it is so displayed as denoted by numeral 32*a* in FIG. 10 and the yellow lamp 41 is lighted up. If the scheduled mileage has been reached and, yet, the engine oil is not replaced or the service reset key 26 is not pressed, the display 32*b* shown in FIG. 11 appears on the display area 12 so as to suggest to the driver to have the engine oil replaced.

The schedule of oil replacement can be freely selected by the user. When the service reset key 26 is pressed for more than two seconds when the engine oil replacement schedule display 32 is being given on the display area 12, the oil replacement schedule display (or "7,500 miles" in this example) in the display area 12 flashes. Then, pressing the arrow key 27 shifts the oil replacement schedule display from 7,500 miles, to 6,000 miles, 5,000 miles, 4,000 miles and so on in a sequential manner. When a desired oil replacement schedule display is obtained, the set key 29 is pressed and this oil replacement schedule is used by the system from then on.

The actions of detecting the arrivals of the times for regular check-ups and oil replacements are all dependent on the cumulative mileage of the vehicle. Therefore, the displays 31*a*, 31*b*, 32*a* and 32*b* (FIGS. 7 and 8 and FIGS. 10 and 11) are produced by interruption routines according to the count of a digital trip meter (odometer) incorporated in the information display system 5. And, once these displays are produced, they are retained until the service reset key 26 or one of the push-buttons 13 and 14 are pressed.

FIG. 12 shows the engine oil level display 33 in normal condition when the engine is not operating. When the engine is being operated, a display 33*a* in FIG. 13 to the effect that the engine oil level reading is not available is given because the engine oil level cannot be detected in a running engine. Therefore, the checking of the engine oil level is made immediately after the ignition switch is turned on. If the engine oil level is detected to be normal, the engine oil level display 33 of FIG. 12 is given for five minutes from the time the ignition switch was turned on, accompanied by the lighting of a green LED lamp 40 included in the display area 12.

The engine oil level display 33 of FIG. 12 is given only for five minutes from the time the ignition switch was turned on and it is thereafter replaced by the engine oil level not available display 33*a* shown in FIG. 13 because it is possible for an engine oil leakage to develop while the engine is running but it cannot be detected by any normal means. Therefore, retaining the display 33 indefinitely could be misleading depending on the circumstance and, therefore, it is more desirable to give the display 33*a* and avoid any misunderstanding.

If the insufficiency of the engine oil level is detected immediately after the ignition switch is turned on, a display 33*b* as shown in FIG. 14 is given and retained. At the same time, the yellow light 41 in the display area 12 is lighted up and a warning lamp in the instrument panel 6 is also lighted up. If desired, a warning buzzer may be activated at the same time. This display 33*b* is retained until either the push-button 13 or the push-button 14 is pressed.

According to the above described logic, the engine oil level OK display 33 may not be obtained after elapsing of the certain time interval even if the engine oil is replenished after the display 33*b* was obtained because the state of the ignition key may be indeterminate. Therefore, according to the present embodiment, the information display system 5 comprises a memory for storing an abnormal state of the engine oil level and permits the detection of the proper engine oil level at all times if the memory contains data indicative of an abnormal condition of the oil level so that the oil level OK display 33 can be obtained as soon as the oil is replenished.

Particularly in cold weather, it takes a substantially long time before the engine oil level can be detected if the engine has been operated only for a short time (which is not enough to warm up the engine) and is stopped. Therefore, it is advantageous to retain the display 33*a* shown in FIG. 13 for a longer time period than usual by detecting such a condition with a timer and a temperature sensor.

As shown in FIG. 15, a vehicle on-board battery 46, an ignition switch 45, an oil level sensor 47 provided in an oil pan (not shown in the drawings) of the engine and a temperature sensor 48 provided in a conduit (not shown in the drawings) for the cooling water of the engine are connected to the information display system 5.

Figure 16:
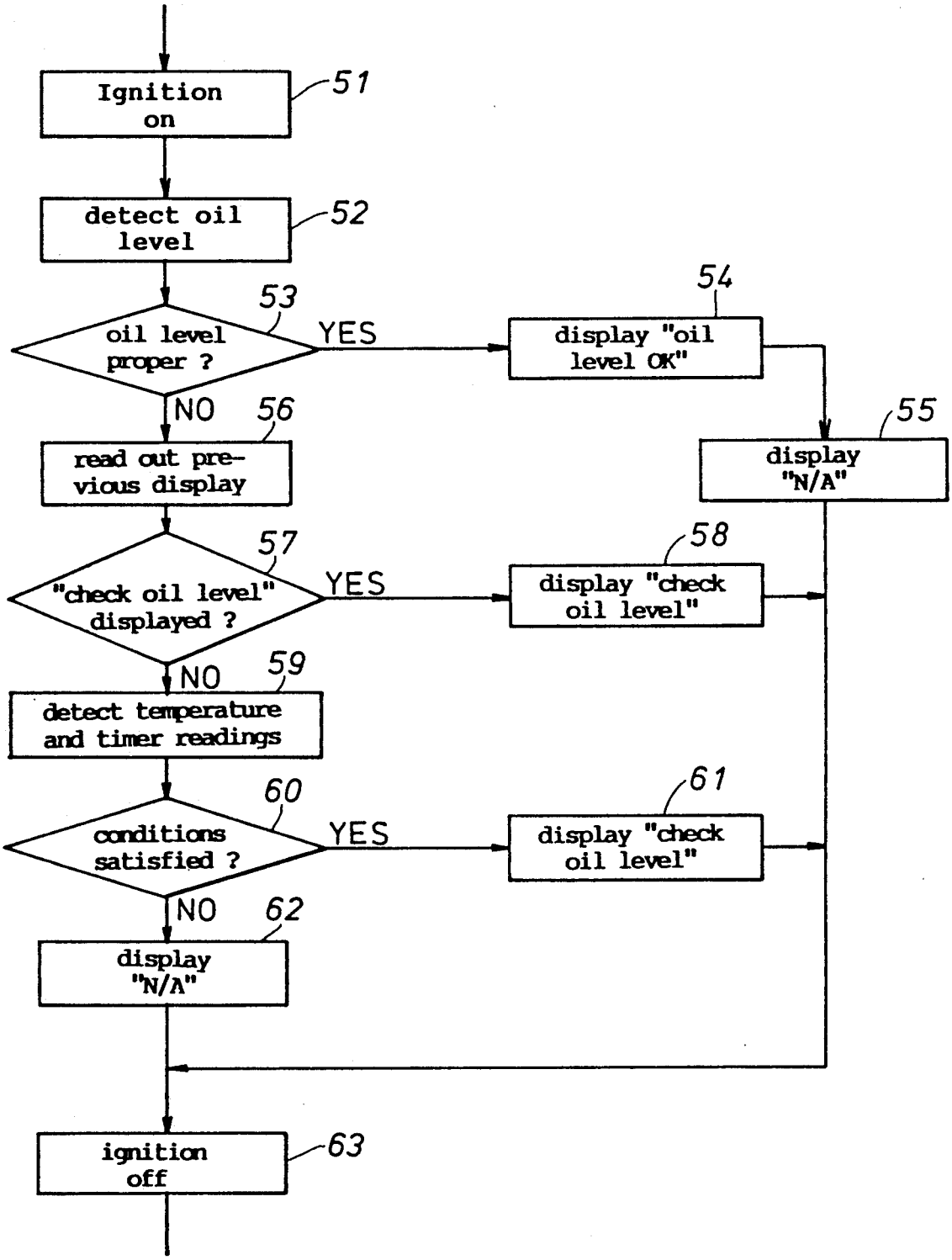
FIG. 16 is a flow chart showing the action of detecting an engine oil level.

FIG. 16 shows a flow chart describing the flow of the system for detecting the condition of the engine oil level. When the ignition switch 45 (FIG. 15) is turned on in step 51, the oil level sensor 47 detects an oil level in step 52. In step 53, it is determined whether the oil level is proper or not. If the oil level is proper, the system flow advances to step 54 and the oil level OK display 33 given in FIG. 6 is shown on the display area 12 and the green lamp 40 is lighted up. The display 33 is retained for only five minutes from the time the ignition switch 45 was turned on and, after elapsing of the five minutes, the engine oil level not available display 33*a* is given in step 55 as shown in FIG. 16.

If the engine oil level is determined to be improper or too low in step 53, the preceding display is read out in step 56 and it is determined whether the preceding display was the engine oil insufficient display 33*b* (FIG. 14) or not in step 57. If the preceding display was indeed the display 33*b*, the display 33*b* is retained in step 58, accompanied by the lighting of the yellow lamp 41 in the display area 12 and the warning lamp in the instrument panel 6. If this is an interruption routine, the warning buzzer is also activated.

If the preceding display was not determined to be the display 33*b* in step 57 of FIG. 16, the temperature sensor 48 (FIG. 15) detects the temperature of the cooling water while the timer incorporated in the system measures the elapsed time after the engine was stopped in step 59. In step 60, it is determined if either a first condition that the cooling water temperature is below a prescribed value such as 50° C. and more than a first time interval, for instance 20 minutes, has passed from the time the engine was stopped (this condition corresponds to the region A in the graph of FIG. 17), or a second condition that the cooling water temperature is higher than the prescribed value (50° C.) and more than a second time interval, for instance 5 minutes, which is shorter than the first time interval, has passed (this condition corresponds to the regions B and D in the graph of FIG. 17) is satisfied or not. If one of the conditions is satisfied, the display 33b is obtained and the yellow lamp 41 in the display area 12 and the warning lamp in the instrument panel 6 are both lighted up (step 61). If this is an interruption routine, the warning buzzer is also activated. If neither condition is satisfied, the engine oil level not available display 33a shown in FIG. 13 is obtained and retained. Here, the displays of steps 55, 58, 61 and 62 are retained until the ignition switch 45 (FIG. 15) is turned off in step 63.

Figure 17:
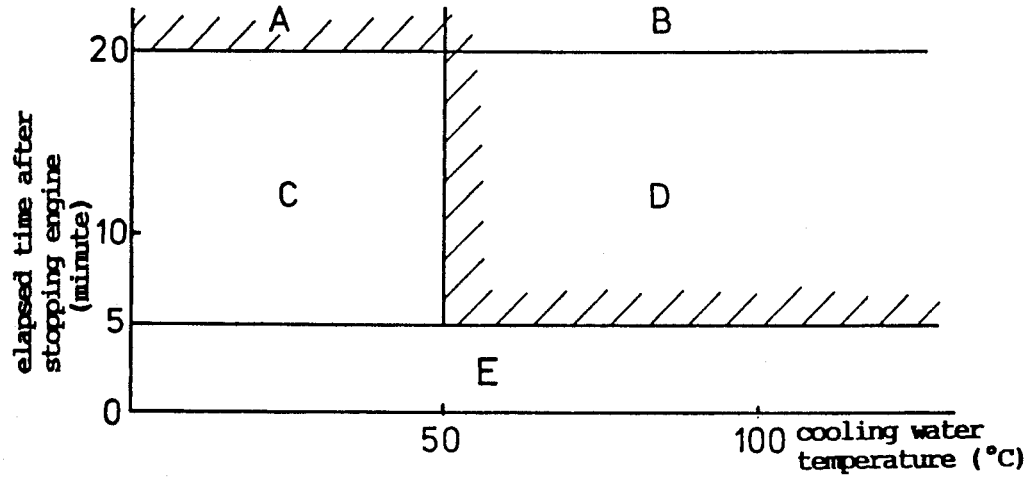
FIGS. 17 through 19 are graphs showing different parametric regions where detection of an oil level is possible.

The graph in FIG. 17 illustrates the determination process in step 60. The vertical axis represents the time period which has elapsed after stopping the engine while the horizontal axis represents the engine cooling water temperature. The upper left region A represents the first condition while the upper right regions B and D extending closer to the horizontal axis than the region A represents the second condition. Therefore, in step 60, if the condition of the engine is within the hatched regions A+B+D (A or B or D), the system flow advances to step 61. Otherwise, or if the condition of the engine is within the non-hatched regions C+E (C or E), the system flow advances to step 62 (FIG. 16).

According to a certain variation of the present invention, the region C may be included in the regions A+B+D where the measurement of an oil level is possible on condition that the engine had operated for more than a certain time interval (for instance 30 minutes) before the engine was stopped. If the engine had operated for a sufficiently long time before the engine was stopped, the engine oil is so fluid that the measurement of the oil level should be possible in a short time (for instance within five minutes) after stopping the engine.

Figure 18:
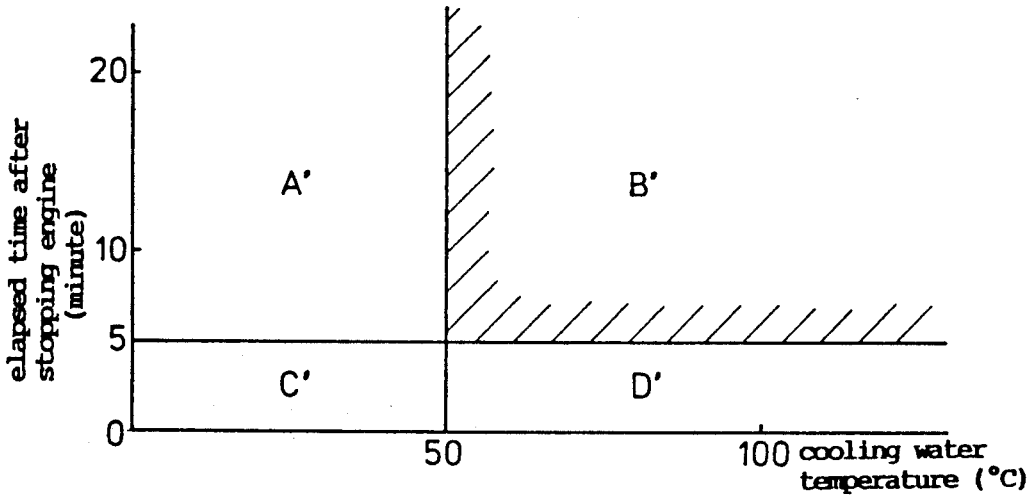

FIG. 18 shows an alternate, simplified logic for the determination process in step 60 (FIG. 16). According to this logic, the check oil level display 33a is made available whenever a certain time interval, for instance five minutes, has elapsed from the time the engine was stopped and the cooling water temperature is higher than a certain value, for instance 50° C. This corresponds to the hatched region B' in FIG. 18. The non-hatched regions A', C' and D' represent the regions where the check oil level display 33a is not available.

Figure 19:
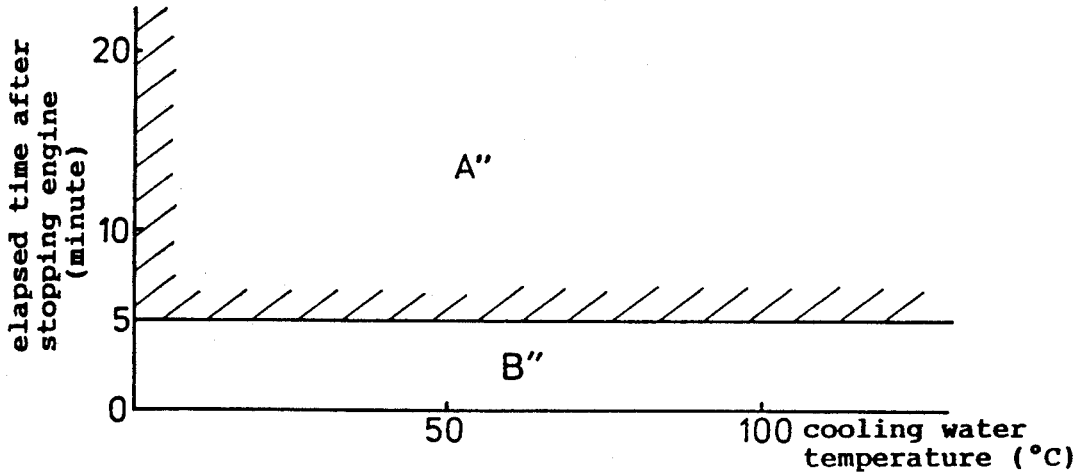

FIG. 19 shows another alternate, simplified logic for the determination process in step 60. According to this logic, the check oil level display 33a is made available whenever a certain time interval, for instance five minutes, has elapsed from the time the engine was stopped irrespective of the cooling water temperature. This corresponds to the hatched region A" in FIG. 19. The non-hatched region B" represents the region where the check oil level display 33a is not available. Optionally, a condition may be added that the engine had been running for more than a certain time period such as 30 minutes before the engine was stopped. This may be added because it takes an extremely long time for the engine oil to return to the oil pan when the engine was operated for only a brief time period whereas, if the engine had operated for a sufficiently long time before the engine was stopped, the engine oil is so fluid that the measurement of the oil level should be possible in a short time after stopping the engine.

Figure 20:
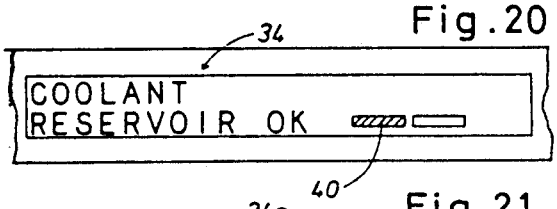
FIGS. 20 through 35 are front views of the display area of the preferred embodiment showing different displays thereon.
Figure 21:
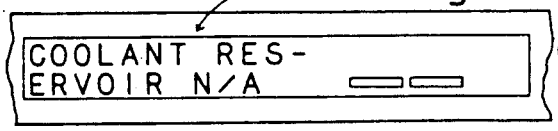
Figure 22:
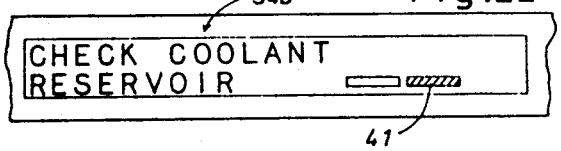

FIGS. 20 to 22 show the coolant level displays 34, 34a and 34b for indicating if the level of the coolant for cooling the engine is higher than an acceptable level or not. Since the coolant level also can not be accurately detected when the engine is running, the display 34a shown in FIG. 21 to the effect that the coolant level is not available is given whenever the engine is running. The coolant level is detected immediately after the ignition switch is turned on. The display 34 in FIG. 20 is obtained if the coolant level is appropriate and the display 34b shown in FIG. 22 is obtained accompanied by the lighting of the yellow lamp 41 if the coolant level is not sufficient. Additionally, in the same way in the case of oil level, a warning lamp and a warning buzzer incorporated in the instrument panel 6 are activated.

Figure 23:
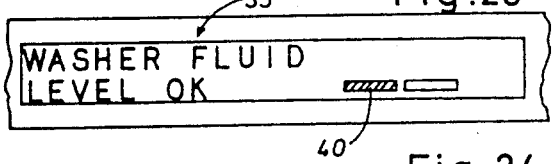
Figure 24:
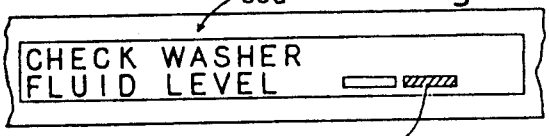

FIG. 23 shows the windshield washer fluid level display 35 in normal condition while FIG. 24 shows the washer fluid level display 35a in abnormal condition. The green lamp 40 is lighted in normal condition and the yellow lamp 41 is lighted in abnormal condition. Since the washer fluid level can be detected continually even when the vehicle is running, the display 35 shown in FIG. 23 is obtained continually as long as the washer fluid level is appropriate.

Among the items of information mentioned above, the oil level display 33 and the coolant level display 34 are obtained when the vehicle is being started. When any abnormal condition of either the oil level cr the coolant level is detected, the display 33b of FIG. 14 or the display 34b of FIG. 22 is obtained by an interruption routine and this state is stored within the system until the replenishment of the oil or the coolant is made. This display 33b or 34b is also retained. By pressing the system check push-button 14, other items of information will be displayed, but the abnormal condition continues to be retained by the system and the abnormal condition is displayed again when the oil level display 33 or the coolant level display 34 is subsequently selected.

On the other hand, the windshield washer level 35 is obtained by continually monitoring the washer fluid level and the abnormal washer level display 35a of FIG. 24 is therefore obtained whenever the washer fluid level has fallen below a prescribed level. When the washer fluid is replenished, it is immediately detected and displayed as shown in FIG. 23. If either the push-button 13 or the push-button 14 is pressed without replenishing the windshield washer fluid, the abnormal display 35a is replaced by another display, but the state of abnormality itself is still stored in memory and the abnormal display 35a is obtained by respectively pressing the push-button 13 or the push-button 14. The key 28 is used for resetting the clock and the odometer.

The above discussion was limited to the cases where the abnormal condition is detected in only one of a plurality of items of information. Now, the action of the system when more than one abnormal condition are detected according to the present invention is described in the following.

According to the present embodiment, the abnormal conditions are stored in a stack memory (a first-in-first-out memory) in the order of their occurrence. When an additional abnormal condition is detected, it is displayed immediately. For instance, when an abnormal condition of the oil level is detected when starting the engine, the display 33b shown in FIG. 14 is obtained and it is retained. If there is no other abnormal conditions, by pressing the push-button 14, the display changes into the displays 34, 35 and 30 in a sequential manner. If the push-button 14 is pressed further, all the check up displays 31, 32, 33*b*, 34, 35 and 30 are obtained in that order, as shown by the hatched arrows in FIG. 4.

Figure 26:
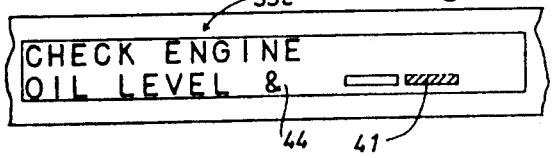

If the mileage of the vehicle has reached a value within 500 miles of the next scheduled maintenance servicing stop in this condition in addition to the abnormality of the engine level, the display 31*a* to this effect shown in FIG. 7 is obtained as a result of an interruption routine. However, in this case, since there are two items of abnormality, the actual display 31*a* contains an "&" mark 44 at the end of the displayed message as denoted by numeral 31*c* in FIG. 25. If the push-button 14 is pressed in this state, the display 33*c* for the abnormal condition of the oil level is obtained as shown in FIG. 26, and this display also includes the "&" mark 44 at the end of the message because the next scheduled maintenance service is almost due (within 500 miles of the next schedule maintenance servicing stop). If the push-button 14 continues to be pressed again, the display shifts to the displays 34 and 35 and then back to the display 30 of FIG. 5. As the push-button 14 is pressed further again, all the check up information displays 31*c*, 32*c*, 33*c*, 34, 35 and 30 are obtained in the order given in FIG. 4.

Figure 27:
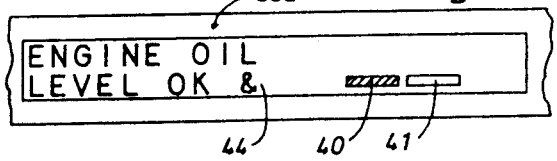

The same principle applies to the displays of other items of abnormality. A transition from an abnormal condition to a normal condition is treated as a form of an abnormal condition and it is displayed. For instance, when the engine is started after replenishing engine oil, the display 33*d* shown in FIG. 27 is obtained. Further, since the mileage is within 500 miles of the next servicing, the "&" mark 44 is added to the end of the message in the display 33*d*. However, items of information on abnormal conditions are retained in memory even after the displays on them are erased and recalled every time when they are to be displayed while the information on transition from an abnormal state to a normal state is erased from the stack memory once it is displayed. Therefore, if the push-button 14 continues to be pressed again and again, the displays 31*c*, 33*d*, 34, 35 and 30 are obtained in that order as long as no additional abnormal conditions arise. As one can note, the abnormal items are given higher priority of display than the other normal items. If the push-button 14 continues to be pressed again and again thereafter, the displays 31*a*, 32, 33, 34, 35 and 30 are obtained in that order.

When an abnormal oil level is detected after the oil replacement schedule abnormal display 32*a* (FIG. 10) was given, the oil level abnormal display 33*c* (FIG. 26) is automatically performed as an interruption routine. Thereafter, pressing the push-button 14 causes the oil replacement schedule abnormal display 32*a* to be displayed. Since the oil level abnormal display 33*c* has already been displayed, when the push-button 14 is pressed again, the time display 30 is obtained. In other words, if two abnormal condition displays A and B are mutually adjacent to each other in their order of normal display and the later one of the displays B is obtained most recently, when the push-button 14 is subsequently pressed, the earlier abnormal display A is obtained. When the push-button 14 is pressed again thereafter, the display B is omitted and the time display 30 is obtained in the display area 12.

Thus, as described above, abnormal conditions and transitions from abnormal conditions to normal conditions are displayed in the order of their occurrence, but, once the clock display 30 is obtained, the displays are obtained in the order given in FIG. 4. For instance, when an occurrence of an abnormal condition and a transition from an abnormal condition to a normal condition have occurred substantially at the same time, it is advantageous if the display for the occurrence of the abnormal condition is given a higher priority than the display for the transition from an abnormal condition to a normal condition. Further, since it is preferable from the stand point of safety if a comprehensive checking procedure is performed when starting the vehicle, the display of the highest priority is obtained when the ignition switch is turned on in the present embodiment. If this display does not contain the "&" mark, the clock display 30 is obtained immediately after the push-button 14 is pressed and the user can readily understand that there is only one item that is required to be checked. If this display contains the "&" mark, then, the user understands that there is more than one item required to be checked and will be able to find out all the items that are required to be checked by keeping pressing the push-button 14 until the clock display 30 of FIG. 5 is obtained.

As described above, abnormal conditions or the transitions from an abnormal condition to a normal condition are obtained in the order of their occurrences, but, once the time display 30 is obtained, the displays are obtained in the order shown in FIG. 4 without any regards to the order of priority. Further, when the occurrence of an abnormal condition and the transition from an abnormal condition to a normal condition have taken place simultaneously, the occurrence of an abnormal condition should be given a higher priority.

In the above described embodiment, the "&" mark was used to indicate that at least one additional item of abnormality to be displayed is stored in the memory of the system but it was not possible to readily indicate the number of items of abnormality which are to be displayed. To eliminate this problem, it is also possible to provide a register which stores the number of data stored in the stack memory and indicate this number next to the "&" mark. Further, marks other than "&" can be used for indicating that there is at least one more item of abnormality to be displayed.

Thus, according to the present embodiment, since all the items of abnormality (optionally, as well as the their number) can be readily demonstrated, the handling of the information display system for a vehicle is improved and a better management of the vehicle is made possible.

Figure 28:
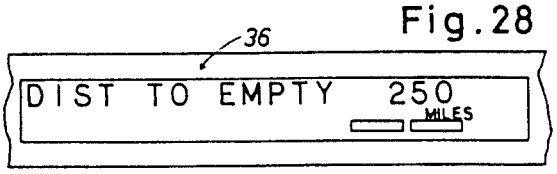

FIG. 28 shows a display 36 for the distance the vehicle can cover with the fuel remaining in the tank of the vehicle. This is obtained by subtracting the cumulative flow rate of fuel injection of the engine from the full capacity of the fuel in the tank and dividing the difference or the estimated quantity of the fuel remaining in the tank by the average mileage per gallon which is obtained as described hereinafter. In other words, the fuel remaining in the tank is estimated by performing this subtraction from the last time the fuel level reset key 24 was pressed. Alternatively, the quantity of the fuel remaining in the tank may be estimated by using a conventional float sensor for detecting the fuel level.

In any case, as the remaining fuel in the tank gets less, the computation involves a greater error and some difficulty arises in obtaining an accurate numerical value on the display. To the end of eliminating this problem, a 2.5 gallon float sensor may be used to detect a 2.5 gallon level. This sensor can accurately detect this level because it does not depend on any cumulative data. From then on, the quantity of the fuel remaining in the tank can be accurately estimated by subtracting the cumulative flow rate of fuel injection from the 2.5 gallon quantity.

Figure 29:
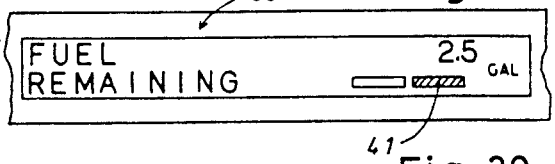
Figure 30:
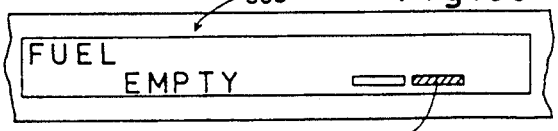

When the amount of the fuel remaining in the tank becomes less than 2.5 gallons, the display 36 is replaced by the display 36a of the quantity of the volume of the fuel remaining in the tank as shown in FIG. 29 because the actual distance which can be covered with the remaining fuel could vary a great deal depending on how the vehicle is driven and the display of the distance could be too misleading in certain circumstances. At the same time, the yellow lamp 41 is lighted to warn the driver. When the fuel remaining in the tank becomes less than one gallon, then, it is displayed as denoted by 36b in FIG. 30 and a warning lamp (not shown in the drawings) mounted in the instrument panel is lighted to issue a strong warning to the driver to replenish the fuel. Optionally, a gallon sensor may be provided for accurately determining the one gallon level. If the fuel level reset key 24 is pressed for more than 3 seconds upon refilling of the tank, the amount of the fuel remaining in the tank is reset to the full amount.

The full tank quantity of fuel may vary depending on the dimensional errors in the tank at the time of manufacture, dents which may have been caused to the tank during the use of the vehicle, the surrounding temperature and so on. In view of this factor, the present embodiment accommodates such fluctuations by permitting an initial setting of the full fuel tank quantity by the user. When the service reset key 26 is pressed for more than two seconds while the display 36 is being obtained, the full tank quantity flashes on the display area 12. By pressing the arrow key 27, the display successively changes to 18.0, 18.5, 19.0, 19.5, 20.0 and again back to 18.0. When a desired full tank quantity display is obtained, the set key 29 is pressed and the initial setting of the full tank quantity is incorporated into the system. This procedure may be performed by the user as an adjustment for any inaccuracy he may have noticed in the display 36.

Figure 31:
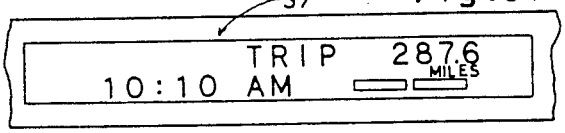

FIG. 31 shows a trip display 37 for displaying a reading of an odometer in addition to a digital clock reading. This trip reading may be reset to zero by pressing the trip reset key 25 for more than two seconds.

Figure 32:
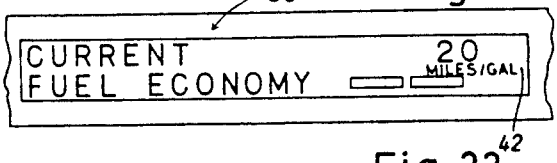
Figure 33:
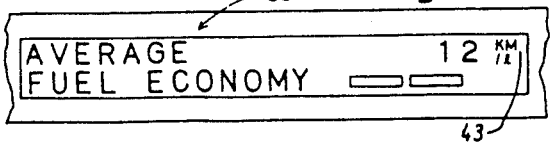

FIG. 32 shows a current fuel mileage display 38 which is obtained by dividing the mileage covered in two seconds by the flow rate of the fuel injectors of the engine in the same two seconds. The injector flow rate is given by:

$$F = T_{ON} \times K_{ON} - N \times K_{er}$$

where is the injector flow rate (cc per second); $T_{ON}$ is the time duration (seconds) of fuel injection; $K_{ON}$ is a fuel injection coefficient (cc/second); N is the number of occurrences of fuel injection in the given time; and $K_{er}$ is an ineffective fuel injection coefficient (cc/injection).

FIG. 33 shows an averaged fuel mileage display 39 which is likewise obtained by dividing the mileage covered by the vehicle after pressing the full fuel tank reset key 24 by the cumulative fuel injector flow rate during the same time period. When the fuel is being filled into the tank, the average fuel mileage is not available. Therefore, a predetermined typical value may be displayed as the display 39.

In the displays 31, 32 and 36 through 39, the units of distance and fuel quantity can be switched between mile/gallon and km/liter by pressing the unit selection key 23. For instance, the mile/gallon units are used in the display 42 shown in FIG. 32 but the km/liter units are used in the display 43 shown in FIG. 33.

If desired, when a certain time interval, for instance ten seconds, has passed after any one of the displays 31 through 35 was selected by the user of the system, a default display such as the clock display 30 may be automatically restored for the convenience of the driver. This time interval begins after any one of the displays was selected. However, it is particularly advantageous if this time interval begins from the time the vehicle started off because it may well be the desire of the user or the driver of the vehicle to retain the display as long as the vehicle remains stationary. Alternatively, the default display may consist of the clock/trip display 37 shown in FIG. 31.

The above mentioned feature was limited to the trip function displays but may also be applied to the maintenance of the system check displays 36 through 39. In this case also, the time interval after which the current display is replaced by the default display may begin either from the time the current display was selected or from the time when the vehicle started off. This feature is particularly advantageous because the handling of the system is not impaired even though a large number of items of information are displayed.

Most items of maintenance information are dependent on the mileage which has been covered by the vehicle. Therefore, when the cumulative mileage stored in the memory is erased due to the repair or other servicing of the control unit of the display system, any further accurate displays of maintenance information will be impossible. It may be conceivable to store the data on the cumulative mileage somewhere else and transmit it to the display system when necessary, but it will unduly complicate the on-board electronic systems. This is particularly undesirable when the display system is intended as optional equipment to the vehicle. Therefore, according to the present embodiment, the cumulative mileage can be set up as desired.

Figure 34:
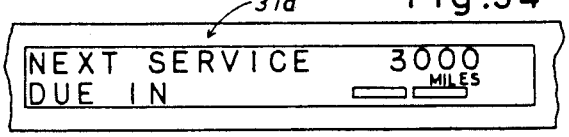
Figure 35:
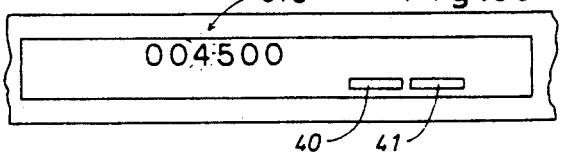

For example, suppose that the display system was repaired and the cumulative mileage stored therein was erased when the next servicing schedule was due in 3,000 miles and the display 31d shown in FIG. 34 was being displayed before the repair. If the cumulative mileage was erased and no measure were taken, the display system would shown a display identical to the display 31 given in FIG. 6 and the distance to the next stop for maintenance servicing would be exaggerated. Therefore, when the display 31 given in FIG. 6 is obtained after the repair, the key 27 is pressed for more than two seconds and a display 31e as shown in FIG. 35 is obtained. One of the numerals shown on the display area 12 flashes and the flashing numeral shifts to the right from one place to another (and back to the left-most place after the flashing numerical place has reached the right-most place) every time the key 27 is pressed. By pressing the key 28, the flashing numeral is successively increased. When thus all the numerical places are assigned with appropriate numerals, by pressing the key 29, the correct cumulative mileage is set up in the system and the default display 30 is restored.

Once the correct cumulative mileage is set up in the system, the control unit automatically computes the remaining distance before the next servicing according to the following formula:

remaining distance before the next servicing stop =

(cumulative mileage which has been manually set up) −

(the remainder when the cumulative mileage before the system repair is divided by the distance between successive servicing stops).

For instance when the distance between successive servicing stops is 7,500 miles and the cumulative mileage is 4,500 miles, the remaining distance is given by:

7,500−(remainder of 4,500/7,500)=3,000

When the distance between successive servicing stops is likewise 7,500 miles and the cumulative mileage is 20,000 miles, the remaining distance is then given by:

7,500−(remainder of 20,000/7,500)=2,500

Thus, the interruption of the management of regular servicing stops is avoided by permitting the manual set-up of the cumulative mileage. Furthermore, this manual set-up is made possible without increasing the number of switch keys.

Figure 36:
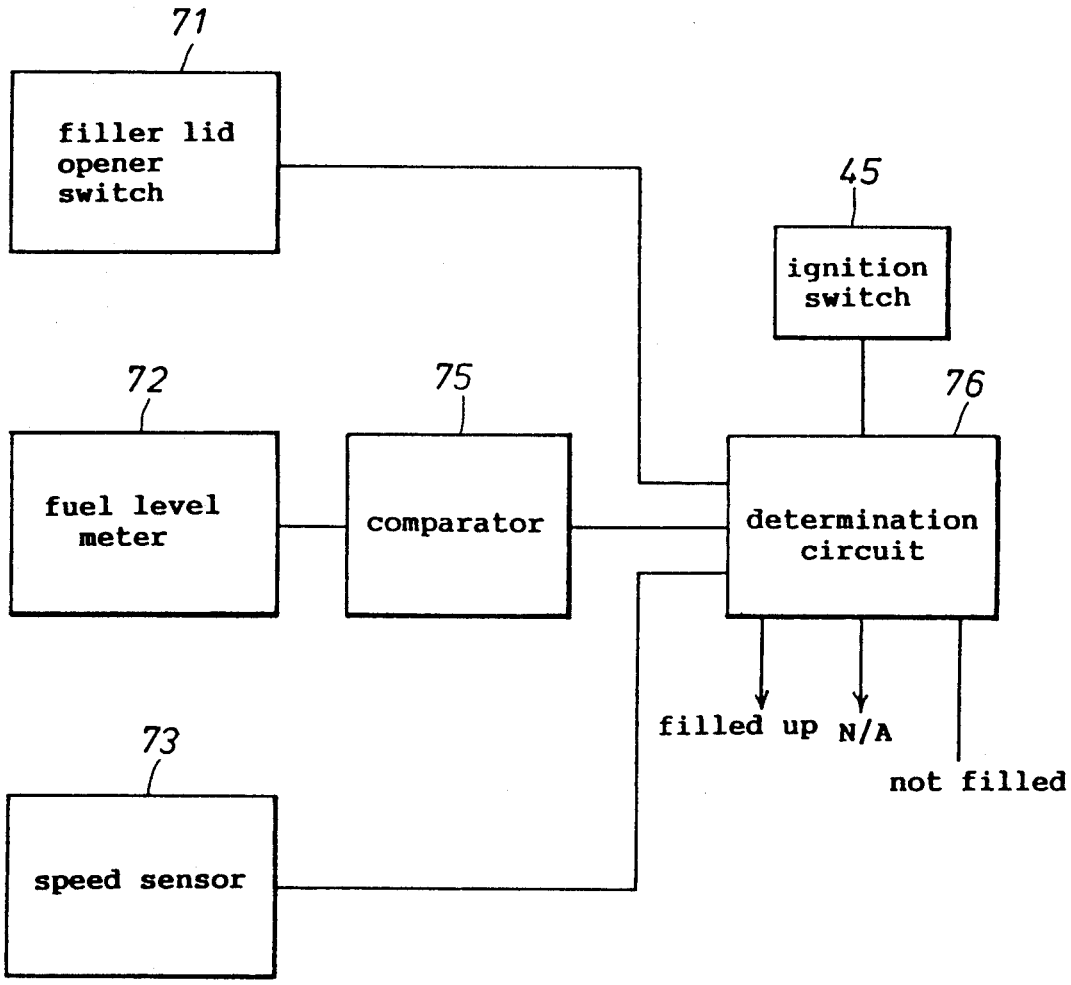
FIG. 36 is a block diagram showing a structure for automatically determining whether the fuel tank has been filled up or not.

In the above described embodiment, a manual switch was used to set up the full tank condition. But, since the user may forget to set the manual switch and, if he forgets to set the manual switch, the information based on fuel consumption will not be available until the next fuel stop is made, it is desirable to use automatic means for registering the filled up state of the fuel tank without involving any efforts by the user and FIG. 36 shows an embodiment of such an automatic switch for determining whether the fuel tank has been filled up or not.

This automatic switch comprises a filler lid opener switch 71 which is activated upon opening of a fuel tank lid or by actuation of a handle provided within the passenger compartment for opening the fuel filler lid, a fuel level meter 72, and a speed sensor 73. The fuel tank lid is normally urged to an open state by a spring and can be opened by actuating the filler lid opener handle. Output V of the fuel level meter 72 is supplied to a comparator 75 and is compared with a prescribed value $V_{full}$ corresponding to a tank full level. Outputs from the filler lid opener switch 71, the comparator 75, the speed sensor 73 and the ignition switch 45 are supplied to a determination circuit 76 which determines whether the tank has been filled up (tank full), no fuel has been filled into the tank (not filled), or there is a chance that fuel has been filled into the tank, however, not to its full level (N/A). The comparator 75 and the determination circuit 76 may consist of either actual circuits or computer programs.

Figure 37:
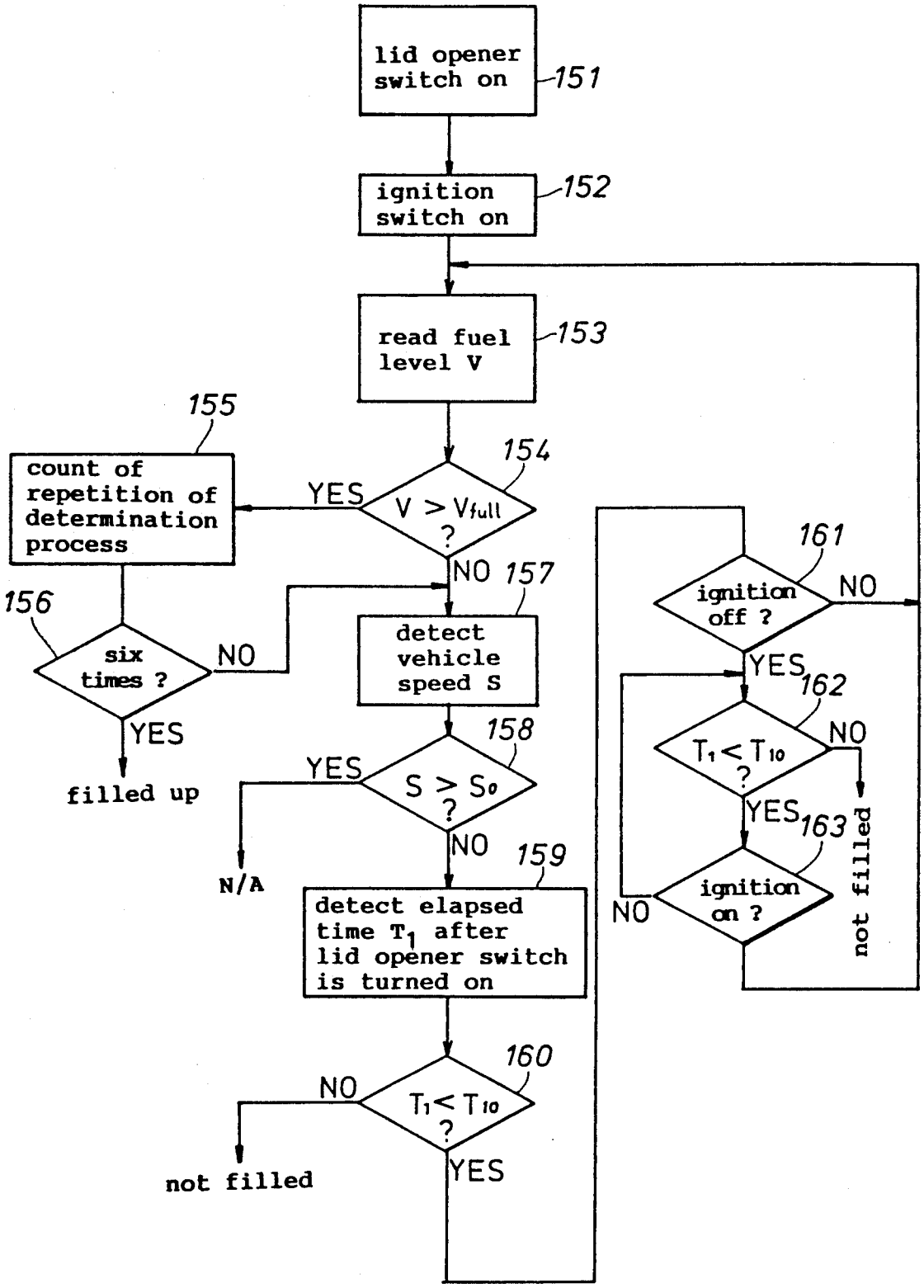
FIGS. 37 and 38 are flow charts showing different procedures for determining whether the fuel tank has been filled up or not with the structure shown in FIG. 36.

Now the action of this automatic switch is described in the following with reference to FIG. 37.

Usually, when fuel is to be filled into the tank, the ignition switch 45 is turned off to stop the engine and the filler lid provided at the inlet of the tank is opened by using a filler lid opener handle provided within the passenger compartment. This is detected in step 151 and the starting of the engine upon completion of filling fuel into the tank is detected as an act of turning on the ignition switch 45 in step 152. The quantity V of the fuel remaining in the tank is read out in step 153 at a certain interval and it is determined in step 154 whether the quantity V is greater than a value $V_{full}$ substantially corresponding to the full level of the tank or not. If the full tank level is detected for six times in steps 155 and 156, it is determined that the tank has been filled up with fuel. Detecting the full level of the tank six times instead of once is for the purpose of increasing the reliability of this automatic switch. If the full level of the tank is not detected for six times, the system flow advances to step 157 because the tank may not have been filled up.

When the tank has not been filled up or, in other words, when a quantity of fuel which is not quite enough to fill up the tank has been filled into the tank, since the quantity of the remaining fuel is determined to be less than the full level $V_{full}$ of the tank, the system flow advances to step 157 and the speed S of the vehicle is measured.

If fuel is not fully filled into the tank or a small quantity of fuel is filled into the tank, since the determination result of step 154 is negative, the system flow likewise advances to step 157 and the speed S of the vehicle is measured. The speed is compared with a prescribed value $S_0$, for instance 30 km/h, in step 158. If the vehicle speed S is greater than the prescribed value $S_0$, it is determined that the filling of the fuel tank has been completed and that fuel may have been filled into the tank but not quite enough to fill it up (N/A). Therefore, it is not possible to identify the exact quantity of the fuel received in the fuel tank and such a display (N/A) is given so as not to cause any misunderstanding.

On the other hand, if the vehicle speed S is determined to be lower than the prescribed value $S_0$, the elapsed time $T_1$ from the time the filler lid opener was operated last time is measured in step 159. This elapsed time interval $T_1$ is compared with a prescribed value $T_{10}$, which may be 30 minutes, in step 160. If this elapsed time interval $T_1$ is shorter than the prescribed value $T_{10}$, it is determined in step 161 whether the ignition switch 45 is off or not. If the ignition switch 45 is not off or, in other words, the ignition switch 45 is still on, the system flow returns to step 153 and the subsequent steps are repeated.

If it is determined in step 160 that the quantity V of the fuel remaining in the tank has not reached the full level $V_{full}$ of the tank within the prescribed time period $T_{10}$ from the time the filler lid opener was actuated, it is then determined in the determination circuit 76 that the filler lid may have been opened but that no fuel was filled into the tank. Therefore, it is judged that there was no change in the quantity of the fuel remaining in the tank and the preceding display is maintained. This is based on the fact that normal filling of a fuel tank is finished well within 30 minutes.

According to this system flow, if the ignition switch is turned on while fuel is being filled into the tank, there is a possibility that electric power would be wasted because the system would continue to repeat the action of detecting the quantity of the fuel remaining in the tank. Therefore, according to the present embodiment, when the ignition switch 45 is turned off again while the action of detecting the quantity of the fuel remaining in the tank is being repeated as a result of turning on the ignition switch while the fuel is being filled into the tank, the system flow advances from step 161 to step 162. In step 162, the elapsed time $T_1$ is compared with the prescribed time interval $T_{10}$. If the elapsed time $T_1$ is less than the prescribed time interval $T_{10}$, the system flow advances to step 163 and it is determined whether the ignition switch has been turned on or not. If the ignition switch 45 is still in the off state, the system flow returns to step 162 and, from then on, steps 162 and 163 are repeated.

If the ignition switch 45 remains off for more than the prescribed time interval $T_{10}$, it is determined that no filling of fuel into the tank has taken place (in step 162). If the ignition switch 45 is turned on within the prescribed time interval $T_{10}$, the system flow returns to step 153 and measurement of the fuel level is repeated again.

The above described action was based on the opening of the filler lid and the closing action of the filler lid was not taken into account. It is possible to provide means for detecting the closing action of the filler lid and to determine the filled up state of the fuel tank by detecting both the opening and the closing action of the filler lid. On the other hand, this requires the provision of contacts or a switch adjacent to the filler lid which is located a long distance away from the instrument panel, and, as a result, not only the manufacturing cost is increased because of the added work and component parts but also the requirement of extra wiring increases the size of the wire harness to an unacceptable extent. According to the present invention, the wiring requirement is limited to a single wiring connection between the filler lid opener and the console which are both located within the passenger compartment, no such problems arise.

If the tank is filled up with fuel while the ignition switch is kept on, the filled up state of the tank is not detected at all. This is not a problem since filling up the tank without turning off the ignition switch is highly undesirable and should be avoided by all means in the first place. Furthermore, even when the filler lid was actuated while the ignition switch is still on, a normal action is assured as long as the ignition switch is turned off and on within a certain time period.

Figure 38:
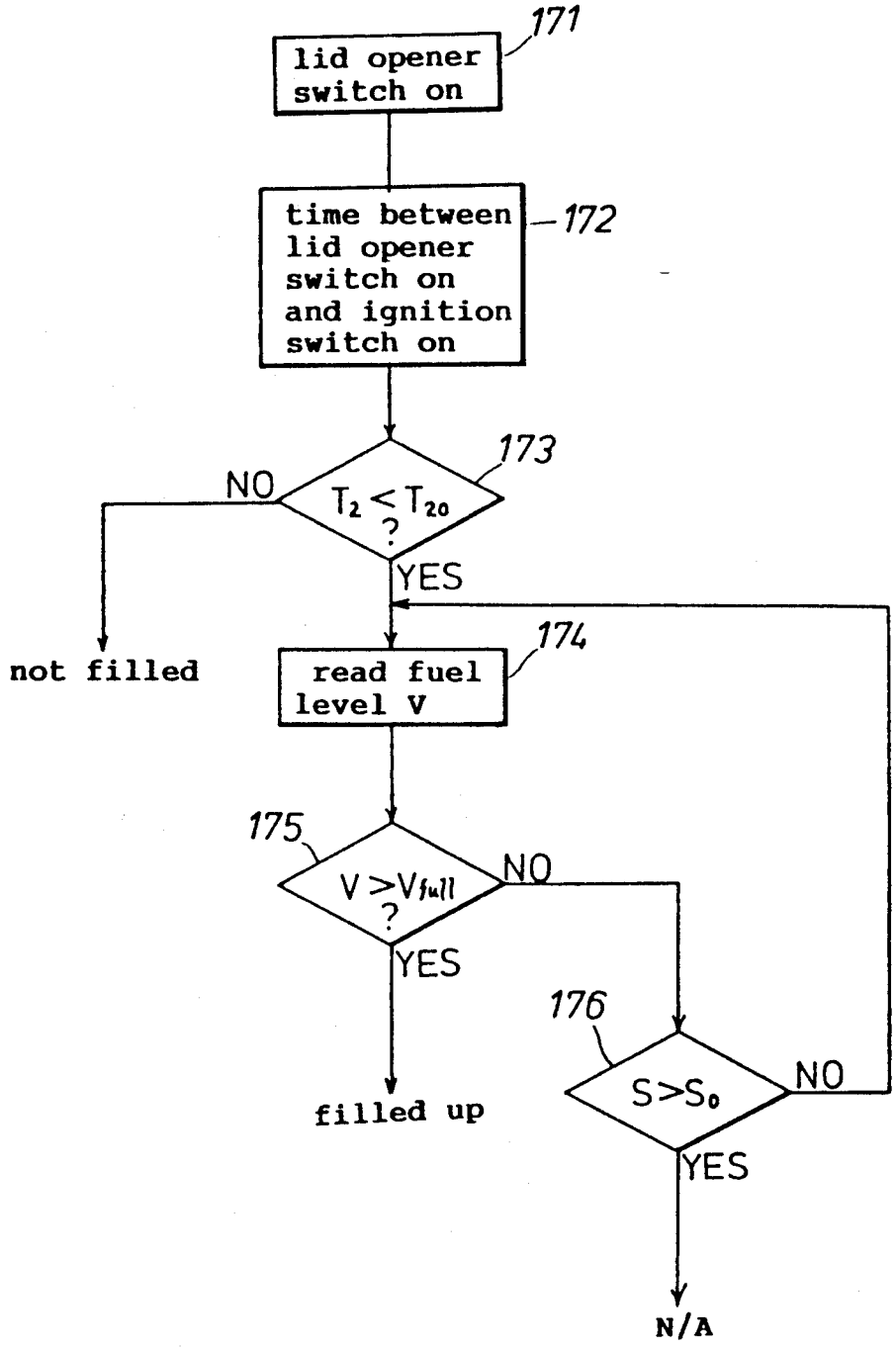

Now the action of a second embodiment of the automatic switch for detecting the filling up of the fuel tank using the same structure shown in FIG. 36 is described in the following with reference to FIG. 38.

Usually, when fuel is to be filled into the tank, the ignition switch 45 (FIG. 15) is turned off to stop the engine and the filler lid provided at the inlet of the tank is opened by using a filler lid opener handle provided within the passenger compartment. This is detected in step 171 and the time interval $T_2$ between the opening of the filler lid and the turning on of the ignition switch 45 is detected in step 172. After the ignition switch 45 is turned on, the time interval $T_2$ is compared with a prescribed time interval $T_{20}$ (which may be, for instance, 30 minutes) in step 173.

If the time interval $T_2$ is shorter than the prescribed time interval $T_{20}$, the fuel level V is detected in step 174 and this level V is compared with a prescribed value $V_{full}$ which corresponds to the full level of the fuel tank, in step 175. If this level V is greater than the prescribed value $V_{full}$, it is determined that the tank has been filled up with fuel.

If some fuel was filled into the tank but not enough to fill it up, the result of the comparison in step 175 is negative and the vehicle speed S is compared with a prescribed value $S_0$ which may be, for instance 30 km/h, in step 176. If the current speed S is greater than the prescribed value $S_0$, it is determined that the filling of fuel into the tank was finished but the tank was not quite filled up, and a display (N/A) indicating that the quantity of fuel remaining in the tank is not known is given.

If the vehicle speed is determined to be less than the prescribed value $S_0$ in step 176, the system flow returns to step 174 and the subsequent steps 174, 175 and 176 are repeated.

If the time interval $T_2$ is determined to be longer than the prescribed time interval $T_{20}$, it is judged that the filler lid was opened by mistake and that no filling of fuel into the tank has taken place (not filled). This is because a normal filling of a fuel tank should be complete well within the prescribed time interval $T_{20}$, for instance 30 minutes.

Figure 39:
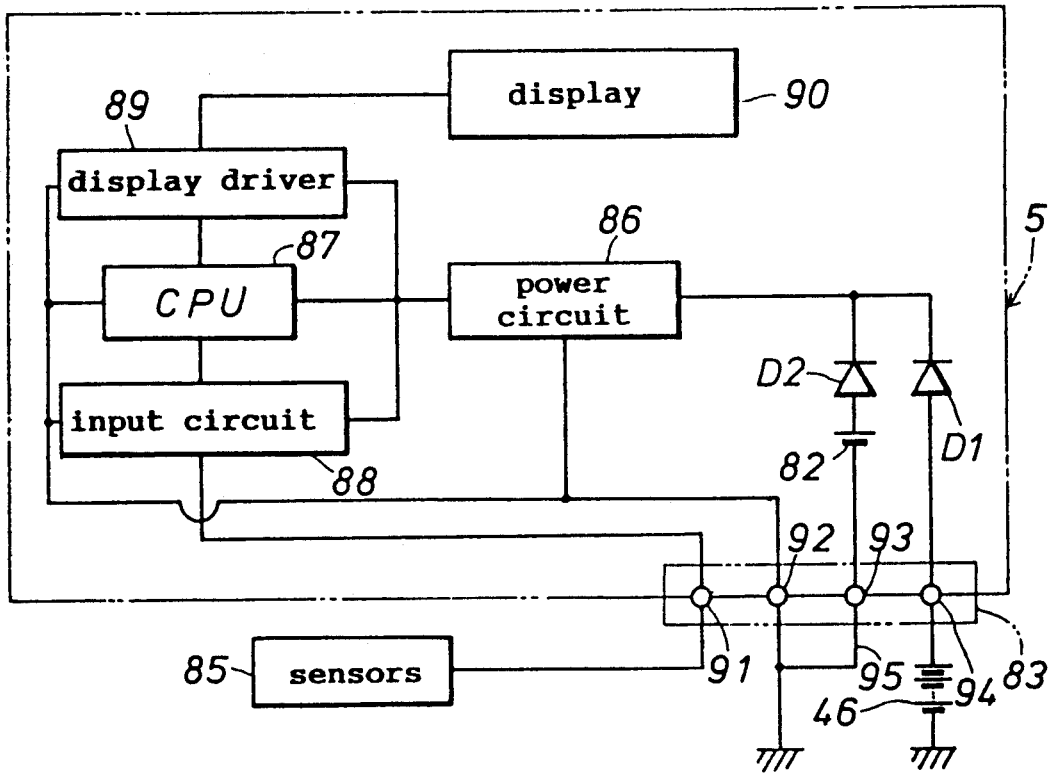
FIG. 39 is a simplified circuit diagram showing a preferred circuit for a backup battery.

FIG. 39 is a circuit diagram of a battery back-up system which is incorporated in the present embodiment. When electronic equipment having an internal clock or erasable memory for storing a set of data which is updated from time to time is removed from the vehicle, the current time or the contents of the memory are lost with the loss of electric power if no power back-up is provided. It is therefore preferable to equip such equipment with a backup battery for avoiding such an inconvenience. On the other hand, storage of such equipment, which may be intended either to be fitted into the vehicle at the time of manufacturing the vehicle or to be fitted into the vehicle as a replacement part or as after-sale equipment, may last for a considerable time period and the backup battery may run out of electricity by the time it is fitted into a vehicle. Therefore, it is desirable to isolate the battery from the rest of the circuit before the equipment is fitted into the vehicle and, yet, to keep the battery connected to the circuit once the equipment is fitted into the vehicle. This circuit was designed to the end of achieving such an arrangement.

As shown in FIG. 39, the information display system 5 is connected to a number of sensors 85 and a vehicle battery 46. Signals from the sensors 85, which may include a vehicle sensor, a fuel level sensor and so on, are supplied to an input circuit 88 by way of a contact 91 of a coupler 83 and are then passed on to a CPU 87 having a memory circuit. The CPU 87 controls a display device 90 by way of display driver 89. The coupler 83 consists of two halves which are adapted to be electrically connected to each other and are provided on the information display system and an element external thereto, respectively.

The positive end of the vehicle battery 46 is connected to an input end of a power source circuit 86 of the information display system 5 by way of a contact 94 of the coupler 83 and a diode D1 while the negative end of the battery 46 is directly grounded. The power source circuit 86 supplies electric power to the CPU 87, the input circuit 88 and the display driver 89. The power source circuit 86, the CPU 87, the input circuit 88 and the display driver 89 are grounded by way of a contact 92 of the coupler 83. The input end of the power source circuit 86 is also connected to a positive end of a backup battery 82 provided within the information display system 5 by way of a diode D2. A negative end of the backup battery 82 is connected to an external line 95 by way of a contact 93 of the coupler 83. The other end of the external line 95 is directly grounded. Since the output voltage of the backup battery 82 is slightly lower than that of the vehicle battery 94, no current flows out from the backup battery 82 as long as the vehicle battery 46 is capable of supplying electric power to the information display system 5.

According to this system, the backup battery 82 is isolated from the rest of the system before the two halves of the coupler 83 are connected to each other.

Therefore, no current is drawn from the backup battery 82 during its storage. However, when the two halves of the coupler 83 are connected to each other after fitting the information display system 5 into a vehicle, the negative end of the backup battery 82 is grounded by way of the external line 95 while the information display system 5 begins drawing electric current from the vehicle battery 46. In this state, no current is drawn from the backup battery 82. When the electric power from the vehicle battery 46 has become unavailable, for instance because of some repair work, replacement of the battery and so on, since the negative end of the backup battery 82 is grounded by way of the external line 95, the information display system 5 now can draw electric current from the backup battery 82.

Although the present invention has been shown and described with reference to the preferred embodiments thereof, it should not be considered as limited thereby. Various possible modifications and alterations could be conceived of by one skilled in the art to any particular embodiment, without departing from the spirit of the invention.

What we claim is:

1. An information display system for a vehicle, comprising:

a plurality of sensors for detecting various conditions of the vehicle;

a display unit for displaying a selected one of a plurality of items of information relating to the conditions of the vehicle as detected by the corresponding sensors;

manual switch means for sequentially shifting the items of information which is currently displayed on the display unit; and control unit comprising automatic selection means for producing one of the items of information on the display unit according to output from one of the sensors;

the control unit further comprising automatic shifting means for changing the item of information which is currently displayed to a display of a default item of information, when the item of information currently displayed was manually selected, upon elapsing of a certain time interval after the manual selection of the current item of information for display wherein, if the manually selected item of information for display is selected when the vehicle is stationary, the time interval begins from the time at which the vehicle is no longer stationary.

2. An information display system for a vehicle as defined in claim 1, the control unit including priority assigning means for assigning a priority of display to an item of information on an abnormal condition or a transition from an abnormal condition to a normal condition over other items of information for display as the current item of information is shifted by the manual switch means.

3. An information display system for a vehicle as defined in claim 2, wherein the priority may be given to a plurality of items of information at a time, and a relatively higher priority is given to the item of information on an abnormal condition or a transition from an abnormal condition to a normal condition of a relatively new occurrence.

4. An information display system for a vehicle as defined in claim 1, wherein the automatic selection means is capable of selecting at least two items of information for display, and the display unit is provided with means for indicating that an additional item was automatically selected by the automatic selection means of the control unit.

5. An information display system for a vehicle as defined in claim 4, wherein the means for indicating that an additional item was automatically selected by the automatic selection means of the control unit comprises a mark appended to each of the displayed items selected by the automatic selection means.

6. An information display system for a vehicle as defined in claim 4, wherein the items of information include an abnormal state of the vehicle and a transition of an abnormal state of the vehicle to a normal state of the vehicle.

7. An information display system for a vehicle as defined in claim 1, wherein the automatic shifting means indefinitely keeps an item of information for display on the display unit when the item was automatically selected by the automatic selection means of the control unit.

8. An information display system for a vehicle comprising:

a plurality of sensors for detecting various conditions of the vehicle;

a display unit for displaying a selected one of a plurality of items of information relating to the conditions of the vehicle as detected by the corresponding sensors;

manual switch means for sequentially shifting the items of information which is currently displayed on the display unit; and control unit comprising automatic selection means for producing one of the items of information on the display unit according to output from one of the sensors;

the control unit further comprising automatic shifting means for changing the item of information which is currently displayed to a display of a default item of information, when the item of information currently displayed was manually selected, upon elapsing of a certain time interval after the manual selection of the current item of information for display; wherein the manual switch means comprises:

a trip function switch for shifting the current item of information displayed on the display unit from one item of information related to a trip function to another item of information related to another trip function in an endless manner;

a maintenance information switch for shifting the current item of information displayed on the display unit from one item of information related to a maintenance item of the vehicle to another item of information related to another maintenance item of the vehicle in an endless manner;

and means for switching the item of information for display from an item of information related to one of the trip functions of an item of information related to one of the maintenance items in case the maintenance information switch was activated when the item of information related to one of the trip functions was being displayed on the display unit, and vice versa.

9. An information display system for a vehicle as defined in claim 8, wherein at least one of the switches comprises a push-button switch having a key top which is hinged so as to be opened for exposing an internal surface when desired, the surface being provided with a initialization switch for setting an initial condition.

10. An information display system for a vehicle as defined in claim 8, wherein the trip function switch is placed closer to a driver's seat of the vehicle than the maintenance information switch.

11. An information display system for a vehicle, comprising:

a plurality of sensors for detecting various conditions of the vehicle;

a display unit for displaying a selected one of a plurality of items of information relating to the conditions of the vehicle as detected by the corresponding sensors, manual switch means for sequentially shifting the item of information which is currently displayed on the display unit; and a control unit comprising automatic selection means for producing one of the items of information on the display unit according to an output from one of the sensors;

the manual switch means comprising:

a trip function switch for shifting the current item of information displayed on the display unit from one item of information displayed to a trip function to another item of information related to another trip function in an endless manner; and a maintenance information switch for shifting the current item of information displayed on the display unit from one item of information related to a maintenance item of the vehicle to another item of information related to another maintenance item of the vehicle in an endless manner;

and the control unit further comprising means for switching the item of information for display from an item of information related to one of the trip functions to an item of information related to one of the maintenance items in case the maintenance information switch was activated when the item of information related to one of the trip functions was being displayed on the display unit, and vice versa.

12. An information display system for a vehicle as defined in claim 11, further comprising memory means for storing a cumulative mileage of the vehicle, and manual setup means for setting up an initial cumulative mileage in the memory means.

13. An information display system for a vehicle as defined in claim 11, wherein there is an item of information which is common to both the trip functions and the maintenance items, and the switching means which is included in the manual switch means switches the item of information currently displayed to a display of this common item of information if the current display is not the common item of information.

14. An information display system for a vehicle as defined in claim 13, wherein the control unit further comprises automatic shifting means for changing the item of information which is currently displayed to the display of the common item of information, when the current display was manually selected, upon elapsing of a certain time interval after the manual selection of the current item of information for display.

15. An information display system for a vehicle as defined in claim 11, wherein the trip function switch and the maintenance information switch are located on either side of a display area of the display unit, and the trip function switch is placed closer to a driver's seat of the vehicle than the maintenance information switch.

16. An information display system for a vehicle as defined in claim 11, wherein at least one of the switches comprises a push-button switch having a key top which is hinged so as to be opened for exposing an internal surface when desired, the surface being provided with a initialization switch for setting an initial condition.

17. An information display system for a vehicle as defined in claim 11, wherein the sensors include:

means for detecting a quantity of fuel in a tank of the vehicle;

and the information display system further includes:

means for detecting a mileage covered by the vehicle;

means for computing a distance which the vehicle can cover with the quantity of fuel remaining in the tank; and means for displaying on the display unit the distance which the vehicle can cover with the quantity of fuel remaining in the tank on the display unit when the quantity of fuel remaining in the tank is greater than a first value and displaying the quantity of fuel remaining in the tank on the display unit when the quantity of fuel remaining in the tank is not greater than the first value.

18. An information display system for a vehicle as defined in claim 17, wherein the fuel quantity detecting means comprises two different fuel quantity sensors, one for detecting the quantity of fuel greater than the first value and the other for detecting an agreement of the fuel quantity with the first value.

19. An information display system for a vehicle as defined in claim 18, wherein the fuel quantity detecting means further comprises a third fuel quantity sensor for detecting an agreement between the quantity of fuel remaining tank with a second value which is smaller than the first value.

20. An information display system for a vehicle as defined in claim 11, further comprising means for permitting detection of a fluid level when an inoperative state of an engine of the vehicle has persisted for more than a certain time interval.

21. An information display system for a vehicle as defined in claim 20, wherein the detection permitting means is provided with memory means for storing an abnormal condition of the fluid level, and further comprising means for permitting detection of a fluid level before the inoperative state of the engine has persisted for the certain time interval.

22. An information display system for a vehicle as defined in claim 20, wherein one of the sensors comprises means for detecting a warmed up state of the engine; the detection of the fluid level being permitted sooner than the certain time interval when the engine is warmed up.

23. An information display system for a vehicle as defined in claim 22, wherein the sensor comprising the means for detecting the warmed up state of the engine comprises an engine cooling water temperature sensor.

24. An information display system for a vehicle as defined in claim 23, wherein the fluid level is an engine oil level.

25. An information display system for a vehicle as defined in claim 20, wherein one of the sensors comprises means for detecting a warmed up state of the engine; the detection of the fluid level being permitted only when the inoperative state of the engine has persisted for the certain time interval and the engine is also warmed up.

26. An information display system for a vehicle as defined in claim 25, wherein the sensor comprising the means for detecting the warmed up state of the engine comprises an engine cooling water temperature sensor.

27. An information display system for a vehicle as defined in claim 26, wherein the fluid level is an engine oil level.

* * * * *